US006871589B2

(12) United States Patent
Hashimoto

(10) Patent No.: US 6,871,589 B2
(45) Date of Patent: Mar. 29, 2005

(54) HYBRID STENCIL PRINTING APPARATUS, METHOD FOR CONTROLLING HYBRID STENCIL PRINTING APPARATUS AND COMPUTER READABLE RECORDING MEDIUM RECORDING PROGRAM FOR THE SAME

(75) Inventor: Koichi Hashimoto, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 10/772,342

(22) Filed: Feb. 6, 2004

(65) Prior Publication Data

US 2004/0177776 A1 Sep. 16, 2004

Related U.S. Application Data

(62) Division of application No. 09/983,345, filed on Oct. 24, 2001, now Pat. No. 6,711,998.

(30) Foreign Application Priority Data

Oct. 31, 2000 (JP) ..... P2000-333469

(51) Int. Cl.[7] ..... B41F 15/10; B41L 13/04; B41M 1/12

(52) U.S. Cl. ..... 101/129; 101/115; 101/116; 101/128.4; 101/490; 358/1.9; 358/1.13

(58) Field of Search ..... 101/114, 115, 101/116, 117, 118, 119, 120, 128.4, 128.21, 129, 484, 490; 358/1.9, 2.1, 1.13, 1.18; 382/162, 165; 347/2, 3

(56) References Cited

U.S. PATENT DOCUMENTS

| | | | | | |
|---|---|---|---|---|---|
| 5,369,507 | A | * | 11/1994 | Tanaka et al. | 358/462 |
| 6,038,977 | A | * | 3/2000 | Haney et al. | 101/490 |
| 6,070,525 | A | * | 6/2000 | Watanabe et al. | 101/129 |
| 6,244,183 | B1 | * | 6/2001 | Haney et al. | 101/490 |
| 6,377,703 | B1 | * | 4/2002 | Yeung | 382/173 |
| 6,688,220 | B2 | * | 2/2004 | Ohno | 101/128.4 |

FOREIGN PATENT DOCUMENTS

| | | | |
|---|---|---|---|
| EP | 0 710 552 | * | 5/1996 |
| EP | 0 771 647 | * | 5/1997 |

* cited by examiner

*Primary Examiner*—Leslie J. Evanisko
(74) *Attorney, Agent, or Firm*—Nath & Associates PLLC; Gary M. Nath; Gregory B. Kang

(57) ABSTRACT

A hybrid stencil printing apparatus comprises: a stencil-making/printing unit configured to perforate a stencil sheet corresponding to a desired image, to wind the stencil sheet around an outer peripheral surface of a print drum, and to transfer a printing medium to the print drum with pressure and the printing medium is printed; an other-method image-formation unit configured to print the printing medium transferred on the same transfer passage as the stencil-making/printing unit according to a different printing method from the stencil-making/printing unit; and an image-formation unit selection-unit configured to input an original digital image, to determine a attributes of each image portion of the inputted original digital image, and to allocate each image portion selectively to the stencil-making/printing unit or the other-method image-formation unit based on the determination result.

6 Claims, 13 Drawing Sheets

HYBRID STENCIL PRINTING APPARATUS, METHOD FOR CONTROLLING HYBRID STENCIL PRINTING APPARATUS AND COMPUTER READABLE RECORDING MEDIUM RECORDING PROGRAM FOR THE SAME

This application is a Divisional of application Ser. No. 09/983,345 filed Oct. 24, 2001 now U.S. Pat. No. 6,711,998, issued Mar. 30, 2004.

BACKGROUND OF THE INVENTION

The present invention pertains to a hybrid stencil printing apparatus including a stencil-making/printing unit and other printing units based on printing methods other than stencil-making/printing unit uses, a control method thereof and a computer-readable recording medium for recording the same control program.

Conventionally, the stencil printing apparatus has been widely used for printing a large number of temporary printed sheets having a quick announcement property, such as advertisement papers folded into newspaper, real-estate advertisements, and communication papers from school-teachers to parents, because it can print at high speed (120 pieces per minute) at a low running cost. The "temporary print" mentioned here refers to, for example, prints, which are to be thrown away without being stored after its information communication purpose has been attained. Under such circumstances, it is important to suppress printing cost, and low-price paper such as pulp paper is often used as print paper.

Such a low-price paper has a feature that its surface is rough. Because emulsion ink used for the stencil printing apparatus has a high viscosity, the emulsion ink is not diffused through exudation when it is transferred to rough paper, enabling a favorable, highly precious picture to be printed.

Most stencil printing apparatus has a structure whereby a printing drum is detachably mounted. Therefore, by preparing printing drums filled with colored ink other than black ink and replacing the printing drum, various colors can be printed out. Further, by overlap-printing with plural printing drums, it is possible to obtain a print composed of plural printing colors so that only the portion desired to be stressed in an original is printed in red although the basic printing color is black. In this specification, printing with a single-color ink is called "spot color printing" in order to distinguish it from "full-color printing" in which three process inks, which colors are cyan, magenta, yellow (CMY) are used.

However, if there is not sufficient room for storage, the number of available colors is restricted, because the printing drum requires a storage place. Although the stencil printing apparatus is capable of making full-color printing if printing drums filled with three process inks such as cyan, magenta, and yellow inks are employed, the registration accuracy of the current stencil printing apparatus is not sufficient, so that it is difficult to register the respective registrations of the cyan, magenta and yellow to such a fine extent without problems in practical use.

On the other hand, the ink jet printer is capable of achieving full color print at a registration accuracy high enough for practical use if provided with a monolithic ink cartridge in which cyan, magenta and yellow inks are integrated. However, because the ink of the ink jet printer has a low viscosity, if it is used on a cheap, rough-surfaced paper such as pulp paper for use in stencil printing machine, the ink is blurred in the directions of the paper fibers so that it blurs, and excellent quality print can not be provided. For this reason, in order to secure a high precision print in the ink jet printer, it is necessary to use special paper capable of suppressing blurring of the ink.

Although as described above, the stencil-printing machine can print a high precision image on rough surface paper, it requires considerable cost for spot color print and there is a problem with registration accuracy when full-color print is carried out.

On the other hand, although the ink jet printer can provide the spot color print and the full color print at such a registration accuracy without any problem in practical use, it cannot provide an excellent quality image on rough-surfaced paper.

SUMMARY OF THE INVENTION

Accordingly, the present invention has been achieved to solve the above described problem and therefore, an object of the invention is to provide a hybrid stencil printing apparatus, a method for controlling the hybrid stencil printing apparatus and a computer-readable recording medium for recording program for the same, capable of carrying out both spot color print and full color print at an excellent image quality even on a rough surface paper.

A hybrid stencil printing apparatus in one embodiment according to the present invention is characterized in that the hybrid stencil printing apparatus includes: a stencil-making/printing unit configured to perforate a stencil sheet corresponding to a desired image, to wind the stencil sheet around outer peripheral surface of a print drum, and to transfer a printing medium to the print drum with pressure, thereby printing the printing medium; an other-method image-formation unit configured to print the printing medium transferred on the same transfer passage as the stencil-making/printing unit according to a different printing method from the stencil-making/printing unit; and an image-formation unit selection-unit configured to input an original digital image, to determine attributes of each image portion of the inputted original digital image, and to allocate each image portion selectively to the stencil-making/printing unit and the other-method image-formation unit based on the determination result.

A method for controlling a hybrid stencil printing apparatus including a stencil-making/printing unit and an other-method image-formation unit, in one embodiment according to the present invention, is characterized in that the method includes: (a) inputting an original digital image, determining attributes of each image portion of the inputted original digital image, and allocating each image portion selectively to the stencil-making/printing unit and the other-method image-formation unit based on the determination result; (b) perforating a stencil sheet corresponding to the image allocated to the stencil-making/printing unit, winding the stencil sheet around outer peripheral surface of a print drum, and transferring a printing medium to the print drum with pressure and thereby printing the printing medium, in the stencil-making/printing unit; and (c) printing the image allocated to the other-method image-formation unit on the printing medium according to a different printing method from the stencil-making/printing unit in the other-method image-formation unit.

A computer-readable recording medium in one embodiment according to the present invention, recording a program for controlling a hybrid stencil printing apparatus including a stencil-making/printing unit and an other-method image-formation unit, is characterized in that the program includes: (a) inputting an original digital image, determining attributes of each image portion of the inputted original digital image, and allocating each image portion selectively to the stencil-making/printing unit and the other-method image-formation unit based on the determination result; (b) perforating a stencil sheet corresponding to the image allocated to the stencil-making/printing unit, winding the stencil sheet around outer peripheral surface of a print drum, and transferring a printing medium to the print drum with pressure and thereby printing the printing medium, in the stencil-making/printing unit; and (c) printing the image allocated to the other-method image-formation unit on the printing medium according to a different printing method from the stencil-making/printing unit in the other-method image-formation unit.

Other object, feature and effect of the present invention will be more apparent from the following detailed description with reference to the drawings below.

DETAILED DESCRIPTION

Figure 1:
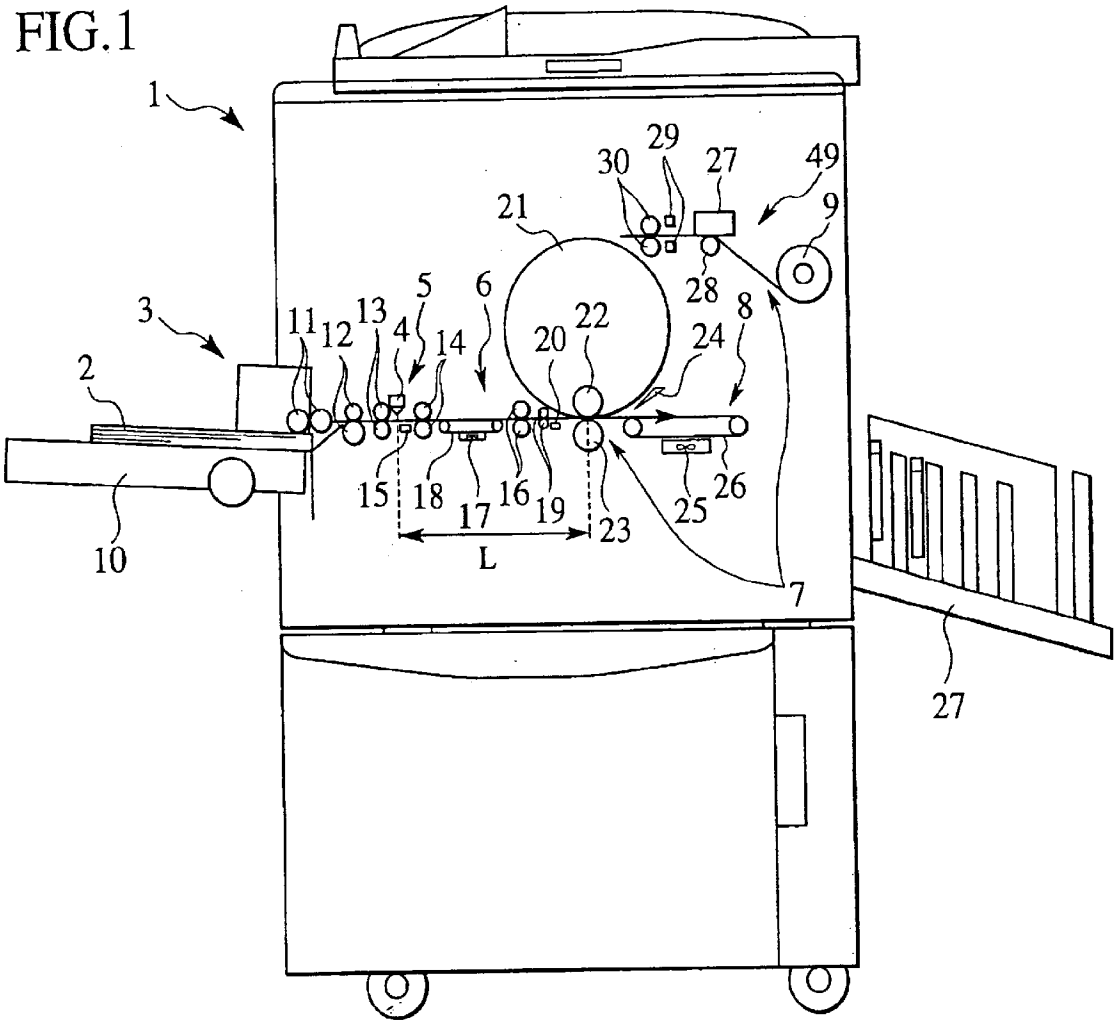
FIG. 1 is a schematic structure diagram for exemplifying the structure of an image-formation unit in the hybrid stencil printing apparatus according to an embodiment of the present invention.

Hereinafter, the embodiment of the present invention will be described with reference to the accompanying drawings.

The hybrid stencil printing apparatus of this embodiment includes (a) a stencil-making/printing unit configured to perforate a stencil sheet corresponding to a desired image, to wind the stencil sheet around outer peripheral surface of a print drum, and to transfer a printing medium to the print drum with pressure, thus printing the printing medium, (b) an other-method image-formation unit configured to print the printing medium transferred on the same transfer passage as the stencil-making/printing unit according to a different printing method from the stencil-making/printing unit, (c) and an image-formation unit selection-unit configured to input an original digital image, to determine attributes of each image portion of the inputted original digital image, and to allocate each image portion selectively to the stencil-making/printing unit and the other-method image-formation unit based on the determination result.

A first feature of the hybrid stencil printing apparatus of this embodiment is characterized in that the image-formation unit selection-unit determines color attributes of each image portion of the original digital image, allocates the image portions in a color which the ink in the stencil-making/printing unit is capable of treating to this stencil-making/printing unit, and allocates the other portions of the image to the other-method image-formation unit.

The "original digital image" mentioned here refers to an original image which has been converted to digital data. This original digital image includes for example, image data obtained by reading a paper original with an image scanner or the like, document data to be edited or created with personal computer word processing software or the like. "The image portions in a color which the ink in the stencil-making/printing unit is capable of treating" refers to those image portions of the original digital image, which can be expressed in the color of ink loaded in the printing drum of the stencil-making/printing unit.

A second feature of the hybrid stencil printing apparatus of this embodiment is characterized in that the image-formation unit selection-unit determines whether each image portion of the original digital image is a vector or bit-map image, allocates the vector image portions to the stencil-making/printing unit, and allocates the bit-map image unit to the other-method image-formation unit.

The "bit-map image" mentioned here refers to an image expressed by arranging picture elements each having density or chromaticity in a grid style, sometimes referred to as raster image. Photograph image is often expressed in bit-map image. An image to be inputted to a stencil-making unit of the stencil printing apparatus is a bit-map image composed of binary data corresponding to perforated and non-perforated areas. An image to be inputted to the print head unit of an ink jet printer is a bit-map image composed of values indicating which ink is to be ejected for each picture element.

On the other hand, the "vector image" refers to an image composed of straight or curved lines. Curved line is expressed in the form of quadratic spline curves or cubic Bezier curves. Because the vector image is expressed by a function in a real coordinate space on a medium on which the image is physically formed, it is not dependent on the resolution of the image-formation unit. An outline font for use in the personal computer is expressed with a vector image. A character string to be outputted from application software of the personal computer is often expressed in vector image. Further, if a graphic image such as a circle or rectangle is drawn with the application software of a word processor or the like, it is often expressed in the form of a vector image. Because the vector image is not dependent on the resolution, it can freely be enlarged or reduced in size.

A third feature of the hybrid stencil printing apparatus of this embodiment is characterized in that the hybrid stencil printing apparatus further includes (d) a manual image allocating unit configured to allocate the image portions in the original digital image selectively to the stencil-making/printing unit and the other-method image-formation unit manually based on the desire of a user, wherein: the image-formation unit selection-unit determines color attributes of each image portion of the original digital image, determines whether the image portion is a vector or bit-map image, allocates the vector image portions in a color which ink in the stencil-making/printing unit is capable of treating to the stencil-making/printing unit; allocates the bit-map image portions in a color which the ink in the stencil-making/printing unit is incapable of treating to the other-method image-formation unit; allocates the bit-map image portions in the color which the ink in the stencil-making/printing unit is capable of treating to the image-formation unit allocated by the manual image allocating unit; and allocates the vector image portions in the color which the ink in the stencil-making/printing unit is incapable of treating to the image-formation unit allocated by the manual image allocating unit.

Further, a fourth feature of the hybrid stencil printing apparatus of this embodiment is characterized in that the other-method image-formation unit mentioned in the first to third feature is an ink jet image-formation unit configured to print by ejecting ink to the printing medium.

FIG. 1 is a schematic structure diagram for exemplifying the structure of an image-formation unit in the hybrid stencil printing apparatus according to this embodiment.

Referring to FIG. 1, the hybrid stencil printing apparatus 1 includes a paper supply unit 3, an ink jet printing unit 5 which is other-method printing unit, a paper transfer unit 6, a stencil-making/printing unit 7, and a paper discharge unit 8. The paper supply unit 3 supplies a print paper 2 as printing medium to the ink jet printing unit 5. The ink jet printing unit 5 prints on the print paper 2 supplied by the paper supply unit 3 by means of an ink jet print head 4. The paper transfer unit 6 transfers the printed paper 2 printed by the ink jet printing unit 5 to the stencil-making/printing unit 7. The stencil-making/printing unit 7 prints the printed paper 2 supplied by the paper transfer unit 6. The paper discharge unit 8 discharges the printed paper 2 printed by the stencil-making/printing unit 7.

The paper supply unit 3 includes a paper supply table 10 on which the print papers 2 are loaded, a primary paper supplying roll 11, and a secondary paper supplying roll 12. The primary paper supplying roll 11 feeds paper sheet by sheet from the print paper 2 at the highest position loaded on the paper supply table 10. The secondary paper supplying roll 12 transfers the print paper 2 supplied by the primary paper supplying roll 11 to the ink jet printing unit 5 at a predetermined interval.

The ink jet printing unit 5 (ink jet image-formation unit) includes the ink jet print head 4 disposed above the paper transfer passage, a pair of upper stream transfer rolls 13, 13 disposed in the upstream of this ink jet print head 4 and a pair of down stream transfer rolls 14, 14 disposed in the down stream of this ink jet print head 4 and a first paper detection sensor 15. The first paper detection sensor 15 detects the leading edge and trailing edge of the print paper 2 and recognizes a print startup reference to the print paper 2. A pair of upper stream transfer rolls 13, 13 and a pair of the down stream transfer rolls 14, 14 are rotated with the printed paper 2 nipped so as to apply a transfer force to the printed paper 2, so that the printed paper 2 is transferred at a predetermined ink jet printing speed.

The paper transfer unit 6 includes a pair of down stream transfer rolls 14, 14 in the ink jet printing unit 5, a pair of transfer rolls 16, 16 disposed in the down stream relative thereto, a transfer belt unit 18 disposed between the transfer rolls 14 and 16 for transferring the printed paper 2 while sucking it to a belt surface by means of a suction fan 17, a pair of paper transfer rolls 19, 19 disposed slightly in the down stream of the pair of the transfer rolls 16, 16 and a second paper detection sensor 20. The second paper detection sensor 20 detects the leading edge of the printed paper 2 and recognizes the waiting position of the printed paper 2. The pair of the down stream transfer rolls 14, 14 serves as a transfer means of the ink jet printing unit 5 as well as the paper transfer unit 6. Then, the paper transfer unit 6 is provided so that the substantial transfer distance between the printing position of the ink jet printing unit 5 and the printing position of the stencil-making/printing unit 7 is a predetermined distance L.

The stencil-making/printing unit 7 includes a stencil-making unit 49, a printing drum 21 on whose outer peripheral face a stencil sheet (not shown) made by the stencil-making unit 49 is mounted, a squeegee roll 22 for supplying ink to the outer peripheral wall of this printing drum 21 from the inner peripheral face thereof, and a pressure roll 23 which is freely movable between a pressing position where it presses the outer peripheral wall of the rotating printing drum 21 and a separate position which is separate from the outer peripheral wall of the printing drum 21. The stencil-making unit 49 includes a stencil paper storage unit (not shown) for storing the long roll of stencil sheet 9, a thermal print head 27 and a platen roll 28 disposed in the transfer down stream of this stored stencil sheet 9, a cutter unit 29 disposed in the transfer down stream of the thermal print head 27 and the platen roll 28, and a pair of transfer rolls 30, 30 disposed in the transfer down stream of the cutter unit 29. In the stencil-making processing, stencil sheet is transferred by rotation of the platen roll 28 and the pair of the transfer rolls 30, 30, this heat-sensitive stencil sheet 9 is perforated by sensing heat by means of the thermal print head 27 based on a desired image data and cutting into a trailing edge of the perforated stencil sheet 9 at predetermined length using the cutter unit 29 so as to prepare the perforated stencil sheet 9 to a predetermined length. In the printing process, when the printed paper 2 is supplied, the pressure roll 23 is pressed on the printing drum 21 on which the stencil sheet is mounted and in a process in which the printed paper 2 is transferred while pressed between the printing drum 21 and the pressure roll 23, ink exuding from a bore in the stencil sheet is transferred to the printed paper 2 so that a predetermined print image is formed.

The paper discharge unit 8 includes a separator 24, a transfer belt unit 26, and a paper receiving tray 27. The separator 24 separates the printed paper 2 forcibly from the printing drum 21 of the stencil-making/printing unit 7. The transfer belt unit 26 transfers the printed paper 2 discharged from the stencil-making/printing unit 7 while sucking to the belt surface by means of the suction fan 25. The printed paper 2 discharged from the transfer belt unit 26 are loaded on to the paper receiving tray 27.

[First Embodiment]

(Selecting an Image-Formation Unit According to the Color in Original Digital Image)

Figure 2:
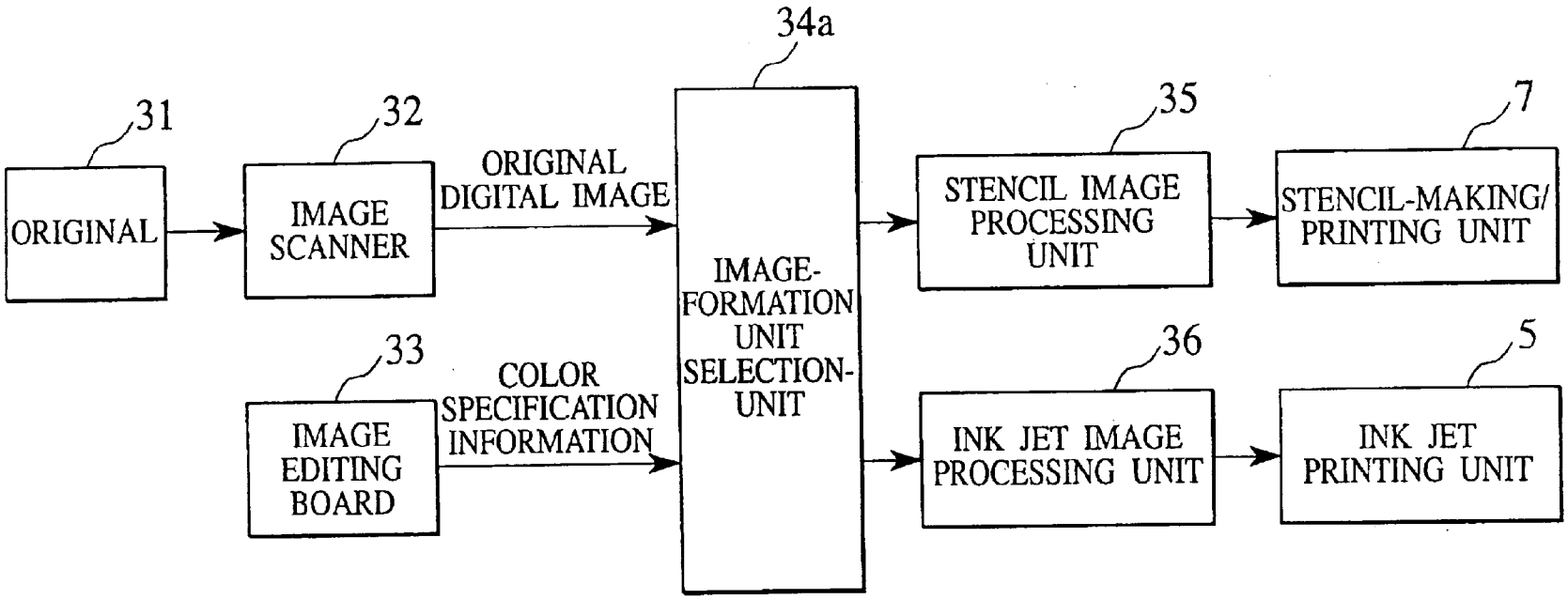
FIG. 2 is a block diagram showing function blocks of the hybrid stencil printing apparatus according to a first embodiment.

FIG. 2 is a function block diagram of the hybrid stencil printing apparatus 1 according to this embodiment. This hybrid stencil printing apparatus 1 includes an image scanner 32 and an image editing board 33.

The image scanner 32 is a unit, which reads an original image 31 drawn on a paper medium and converts it to original digital image data. By illuminating an original 31 with light, its reflected light or transmitted light is received by an image sensor like a Charge Coupled Device (CCD) so as to transform the picture image into digital signal.

The image editing board 33 is, for example, a coordinate input unit such as a digitizer, in which a region of the original image 31 on the paper placed on the image editing board 33 is specified using a pen or a mouse-like input device and for each region the specification of image binarization processing method (specifying which binarization method is carried out, single value thresholding or screening) or the specification of color can be carried out.

The original digital image data outputted from the image scanner 32 and color specification information outputted from the image editing board 33 is inputted to an image-formation unit selection-unit 34*a*. An image-formation unit is selected for each image portion in the original digital image data according to a processing procedure in the flow chart shown in FIG. 3. The operation of the control program of the hybrid stencil printing apparatus 1 of this embodiment is controlled according to a processing procedure shown below (see FIG. 3).

First, it is judged whether the color specified in an image portion in the original digital image is the same as the color of the ink in the printing drum 21 of the stencil-making/printing unit 7 of the hybrid stencil printing apparatus 1 (step 01).

If the color specified for the image portion in the original digital image data is the same as the color of the ink filling the printing drum 21 of the stencil-making/printing unit 7 in the hybrid stencil printing apparatus 1, the stencil-making/printing unit 7 is selected as a printing means for the image portion (step 02). That image portion is sent to a stencil image processing unit 35, in which stencil image processing is carried out and then, stencil-making and printing are carried out in the stencil-making/printing unit 7.

Conversely, if the color specified for the image portion is not the same as the color of ink filling the print drum 21 of the stencil-making/printing unit 7 in the hybrid stencil printing apparatus 1, ink jet printing unit 5 is selected as a printing means for that image portion (step 03). That image portion is sent to ink jet image processing unit 36, where image processing for ink jet is carried out and then, printing is carried out in ink jet printing unit 5.

Figure 4:
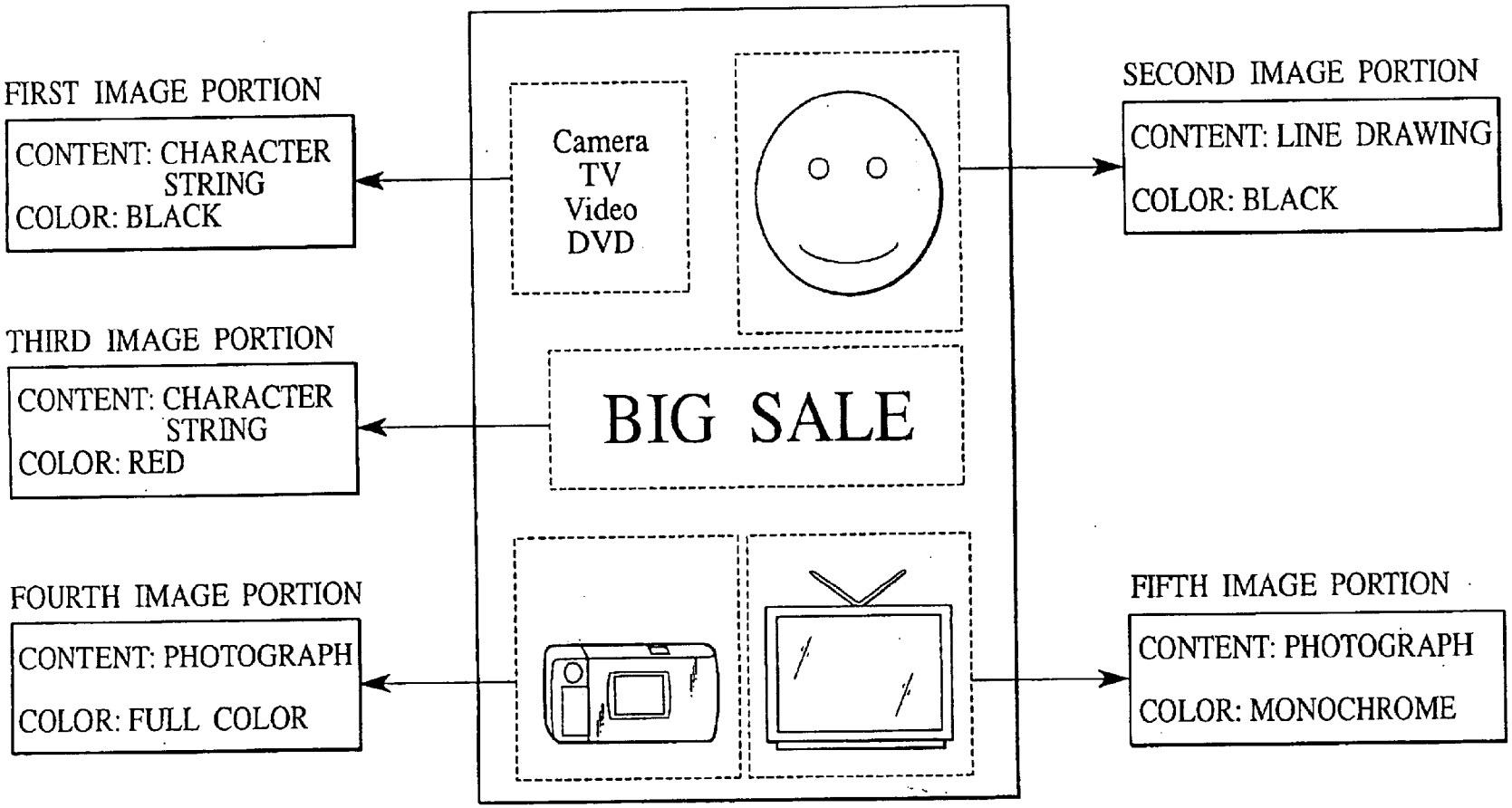
FIG. 4 is an image diagram showing an example of an original digital image in the hybrid stencil printing apparatus of the first embodiment.

For example, assume that an ink drum filled with "black" ink is loaded on the stencil-making/printing unit 7 in the hybrid stencil printing apparatus 1 and a color ink cartridge is mounted on the inkjet printing unit 5. Then, if the original digital image data shown in FIG. 4 is used as the image portions (first to fifth image portions) of the original digital image, the image-formation unit shown in Table 1 are selected.

TABLE 1

| Original image portion | Content | Color | Stencil-making/ printing unit | Ink jet printing unit |
|---|---|---|---|---|
| First image portion | Character string | Black | Selected | Not selected |
| Second image portion | Line drawing | Black | Selected | Not selected |
| Third image portion | Character string | Red | Not selected | Selected |
| Fourth image portion | Photograph | Full color | Not selected | Selected |
| Fifth image portion | Photograph | Monochrome | Selected | Not selected |

Because as shown in Table 1, the character string data in the first image portion and the line drawing data of the second image portion are specified as "black", the stencil-making/printing unit 7 filled with "black" ink is selected. Further because the photographic data of the fifth image portion is "monochrome", the stencil-making/printing unit 7 is selected.

Because the specified color for the character string in the third image portion is "red", the stencil-making/printing unit 7 filled with "black" ink is not capable of printing the color and therefore, the ink jet printing unit 5 is selected. Further, because the photograph data in the fourth image portion is "full color", the ink jet printing unit 5 is selected.

An image portion in color which the stencil-making/printing unit 7 cannot treat is allocated to other-method image-formation unit, so that a print result of color faithful to the original can be obtained. Further, because the image formation of a portion corresponding to the color of ink in the stencil-making/printing unit 7 such as character and line drawing is allocated to the stencil-making/printing unit 7, an excellent print image can be provided to even a rough surface paper.

Further, because the printing of respective image portions by the stencil-making/printing unit 7 and the ink jet printing unit 5 to each sheet of print paper 2 are carried out in sequence during a single transfer operation, there is little cause for concern that the relative positions of the image portions may be dislocated, and a print image with excellent registration accuracy can be provided.

[Second Embodiment]

(Selecting an Image-Formation Unit Based on the Colors of the Original Digital Image)

Figure 5:
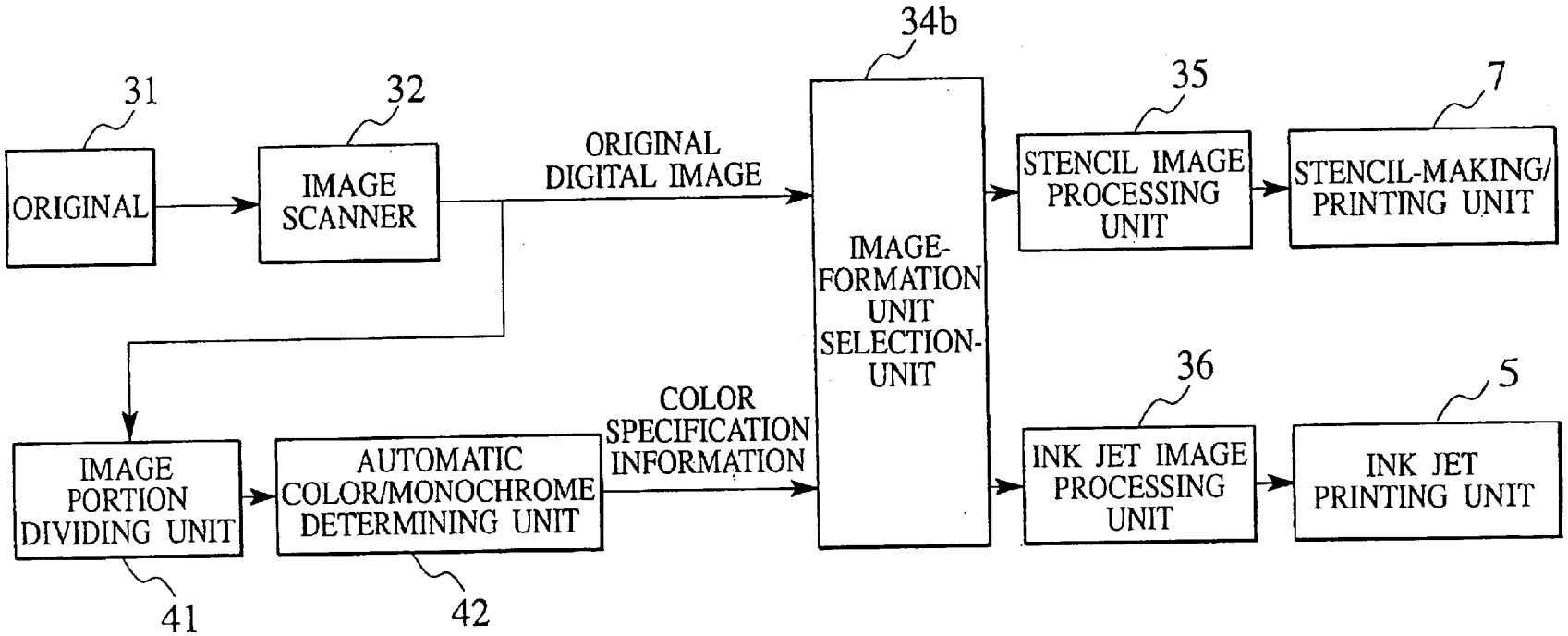
FIG. 5 is a block diagram showing function blocks of the hybrid stencil printing apparatus according to a second embodiment.

FIG. 5 is a function block diagram of the hybrid stencil printing apparatus 1 of this embodiment. This hybrid stencil printing apparatus 1 includes an image scanner 32, as in the first embodiment.

Further, this hybrid stencil printing apparatus 1 contains an image portion dividing unit 41 configured to divide the image portions of the original digital image read by the image scanner 32 into small units and an automatic color/monochrome determining unit 42 configured to determine the color attributes (whether color or monochrome) of the divided small image portions. This image portion dividing unit 41 and the automatic color/monochrome determining unit 42 can be realized in software, for example.

The image portion dividing unit 41 divides original digital image into small image portions. At this time, the size of the small image portions should be a square of side 1 mm approx. If the resolution of the image scanner is 600 dpi (dot per inch), a square of side 1 mm approx. of the original is a small image portions of 24- by 24-pixels.

Figure 6:
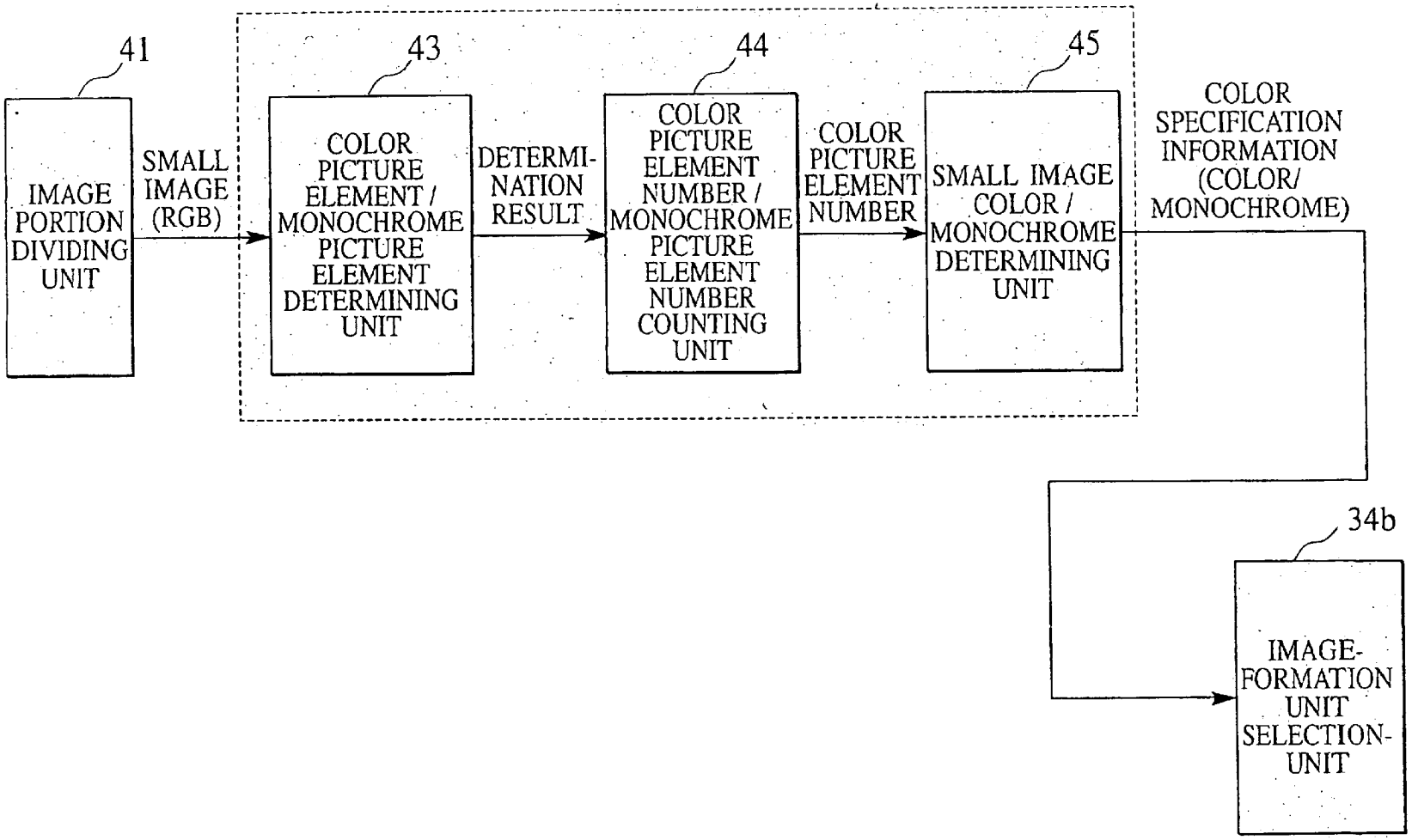
FIG. 6 is a block diagram showing function blocks of an automatic color/monochrome determining unit in the hybrid stencil printing apparatus of the second embodiment.

FIG. 6 shows detailed function blocks of the automatic color/monochrome determining unit 42 shown in FIG. 5, which includes a color element/monochrome element determining unit 43, a color element number/monochrome element number calculating unit 44 and a small image color/monochrome discriminating unit 45.

The color element/monochrome element determining unit 43 determines whether the divided small picture element is color picture element or monochrome picture element from a computation result of Red (R), Green (G) and Blue (B) values. Upon determination, for example, an evaluation value J is obtained according to the following expression (1) for evaluation.

$$J=(R-G)^2+(G-B)^2+(B-R)^2 \quad (1)$$

The nearer, the R, G, B values, the smaller the J value becomes, and the further apart, the larger it becomes. That is, if a color is deviated, that value becomes larger and if a color is not deviated, that is, it is monochrome, it becomes smaller.

The threshold value T for evaluating the evaluation value J is obtained as follows. A value which is larger than J calculated on a monochrome patch and smaller than J calculated on color patches using the R, G, B values obtained by reading the patches through the image scanner 31 is regarded as threshold value T. The determination is carried out according to the rule described below.

"If J>T, color picture element, and if J<=T, monochrome picture element"

A color picture element number/monochrome picture element number counting unit 44 counts the number of color picture elements using the above described determination result. If the size of small images is fixed, the number of the monochrome picture elements is automatically determined based on the number of the color picture elements.

A small image color/monochrome determining unit 45 evaluates the number of the color picture elements outputted from the color picture element number/monochrome picture element number counting unit 44 so as to determine whether the relevant small image is in color region or monochrome region. The determination is carried out according to the following rule.

"If Nc>αNp, color region and if Nc<=αNp, monochrome region"

(where Nc is the number of color picture elements, Np is the number of picture elements composing the small image and α is a constant)

The constant α is determined as follows. If there is a character that has been output by a monochrome laser printer in the original, it should be determined as a monochrome region. However, if such a character has been read by the color image scanner, the boundary between toner forming the character and paper is read as a color picture element and even if the original is monochrome, the color picture element number Nc is not zero. Thus, the color picture element number Nc is calculated by reading some pieces of the monochrome originals and the constant α, whereby αNp is larger than the color picture element number Nc, is applied.

Figure 3:
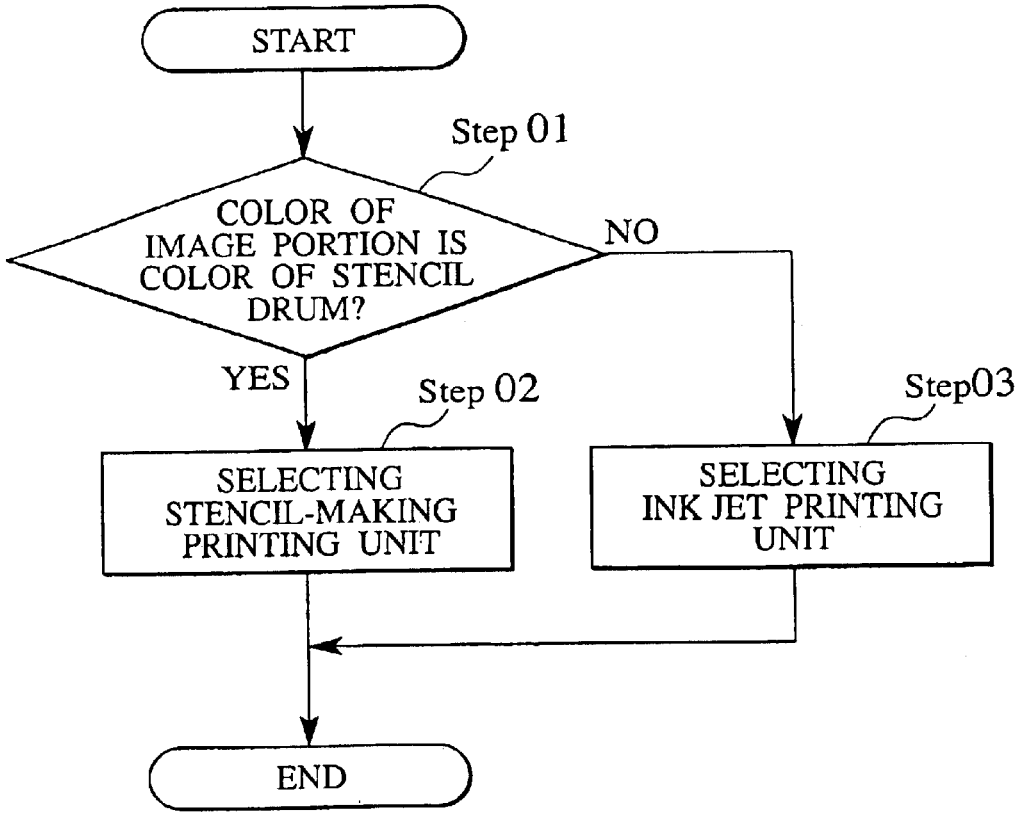
FIG. 3 is a flow chart showing the processing procedure of the image-formation unit selection-unit in the hybrid stencil printing apparatus of the first embodiment.

The original digital image data outputted from the image scanner and the color specification information of each image region outputted from the automatic color/monochrome determining unit 42 are inputted to the image-formation unit selection-unit 34*b* and the image-formation unit is selected for each image portion in the original digital image data according to the processing procedure in the flow chart of FIG. 3 as in the first embodiment.

Assume that an ink drum filled with "black" ink is loaded on the stencil-making/printing unit 7 of the hybrid stencil printing apparatus 1 and a color ink cartridge is loaded on the ink jet printing unit 5, as in the first embodiment. If the original digital image data shown in FIG. 4 is used, the image-formation unit selected for each of the image portions (first to fifth image portions) is as shown in Table 1.

[Third Embodiment]

(Selecting an Image-Formation Unit Based on the Color of the Original Digital Image)

Figure 7:
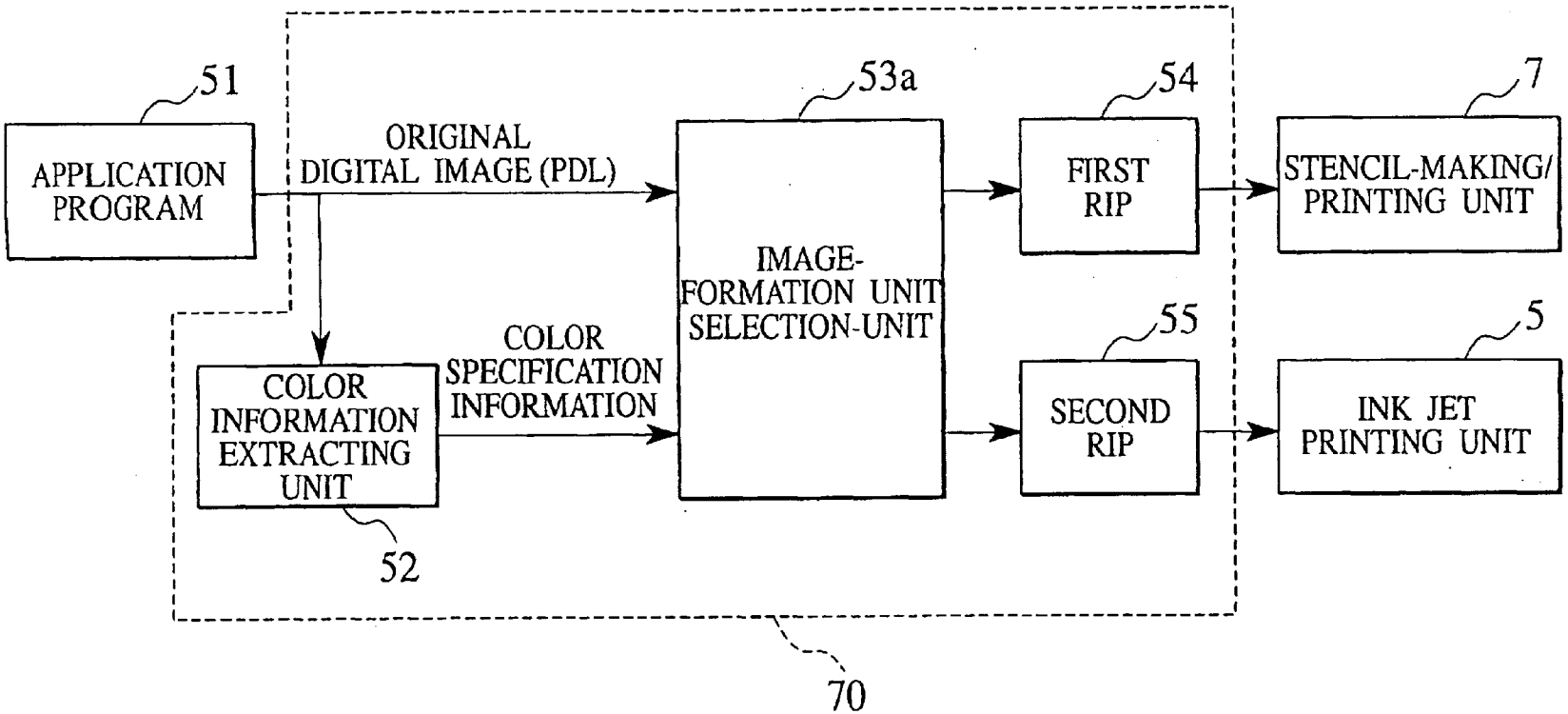
FIG. 7 is a block diagram showing function blocks of the hybrid stencil printing apparatus according to a third embodiment.

The hybrid stencil printing apparatus 1 of this embodiment is connected to a personal computer installed with, for example, a word processing application software as shown in FIG. 7. The application program 51 in FIG. 7 is an application software installed in a personal computer. A color information extracting unit 52, an image-formation unit selection-unit 53*a*, a first RIP 54 and a second RIP 55 are the functions of a printer driver 70 installed in the personal computer.

The original digital image, which is created by the application program 51 and outputted, is described with Page Description Language (PDL). Page description language is a language for use in conveying a print image to the printer and expresses both the character and graphic in the form of vector data elements composing the page. The printer transforms that data to bit-map data in the unit of page and prints out. Photograph and the like are expressed in bit-map according to the rule of PDL.

The color information extracting unit 52 extracts color specification information from each image region in the original digital image (PDL) outputted from the application program 51.

If the color specification information outputted by the color information extracting unit 52 corresponds to the ink in the stencil-making/printing unit 7, the image-formation unit selection-unit 53*a* outputs original digital image to the first RIP 54 according to the processing procedure shown in FIG. 3 as in the first and second embodiments, and if otherwise outputs to the second RIP 55. The "RIP" is an abbreviation for a Raster Image Processor, which transforms an image described according to the PDL rule to a raster image (bit-map image) corresponding to the color and resolution of the printer (image-formation unit).

Thus, the first RIP 54 transforms the original digital image to a raster image corresponding to the print color and resolution of the stencil-making/printing unit 7 in the hybrid stencil printing apparatus 1 and sends it to the stencil-making/printing unit 7. The second RIP 55 transforms the original digital image to a raster image corresponding to the print color and resolution of the ink jet printing unit 5 in the hybrid stencil printing apparatus 1 and sends it to the ink jet printing unit 5.

Assume that an ink drum filled with "black" ink is loaded on the stencil-making/printing unit 7 of the hybrid stencil printing apparatus 1 and a color ink cartridge is loaded on the ink jet printing unit 5 as in the first and second embodiments. If the original digital image data shown in FIG. 4 is used, the image-formation unit selected for each of the image portions (first to fifth image portions) is as shown in Table 1.

[Fourth Embodiment]

(Selecting an Image-Formation Unit Based on whether the Original Digital Image is of Vector or Bit-Map Data)

Figure 8:
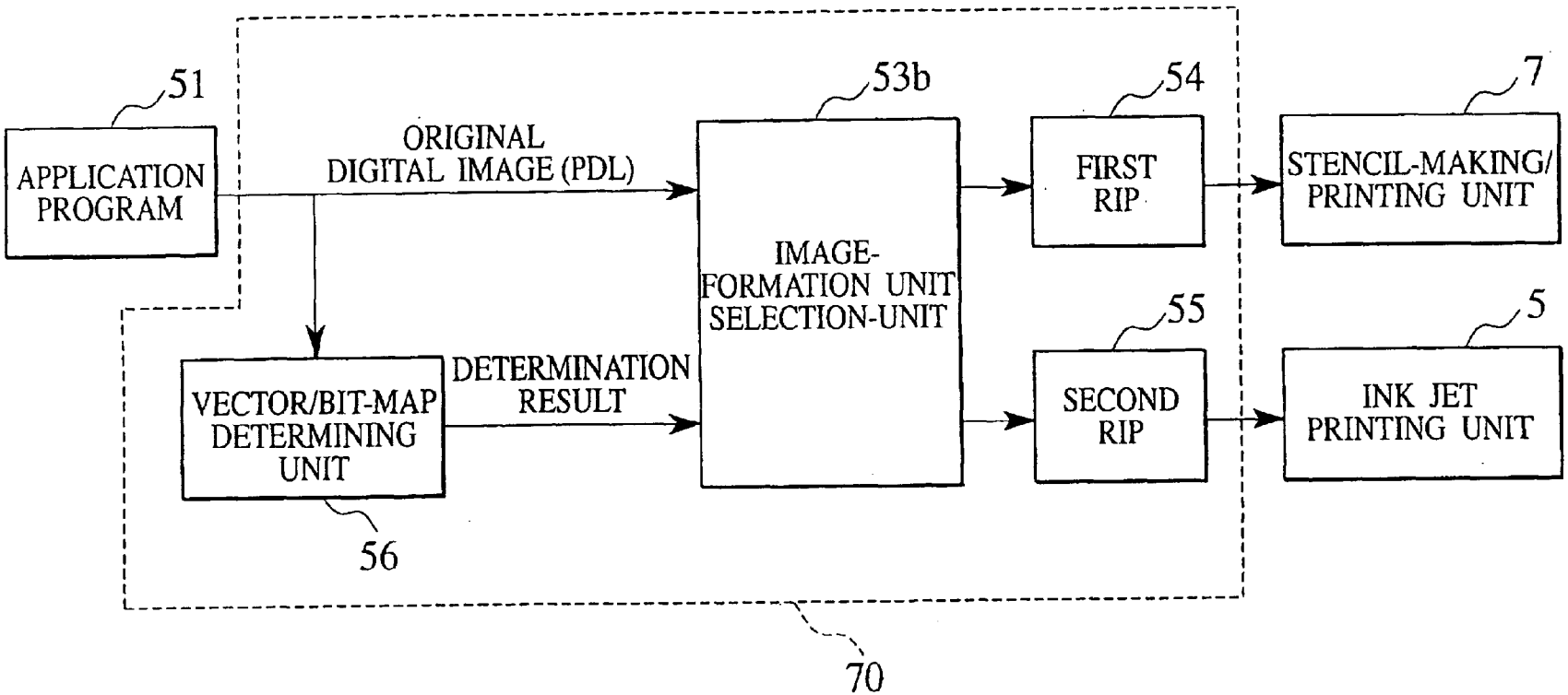
FIG. 8 is a block diagram showing function blocks of the hybrid stencil printing apparatus according to a fourth embodiment.

The hybrid stencil printing apparatus 1 of this embodiment is connected to a personal computer installed with, for example, a word processing application as shown in FIG. 8. The application program 51 in FIG. 8 is an application software installed in a personal computer. A vector/bit-map determining unit 56, an image-formation unit selection-unit 53*b*, a first RIP 54 and a second RIP 55 are the functions of a printer driver 70 installed in the personal computer.

The original digital image, which is created by the application program 51 and outputted, is described with page description language (PDL) as in the third embodiment.

A vector/bit-map determining unit 56 determines whether each image region in the original digital image (PDL) outputted from the application program 51 is expressed in vector or bit-map data and outputs the determination result to the image-formation unit selection-unit 53*b*.

Figure 9:
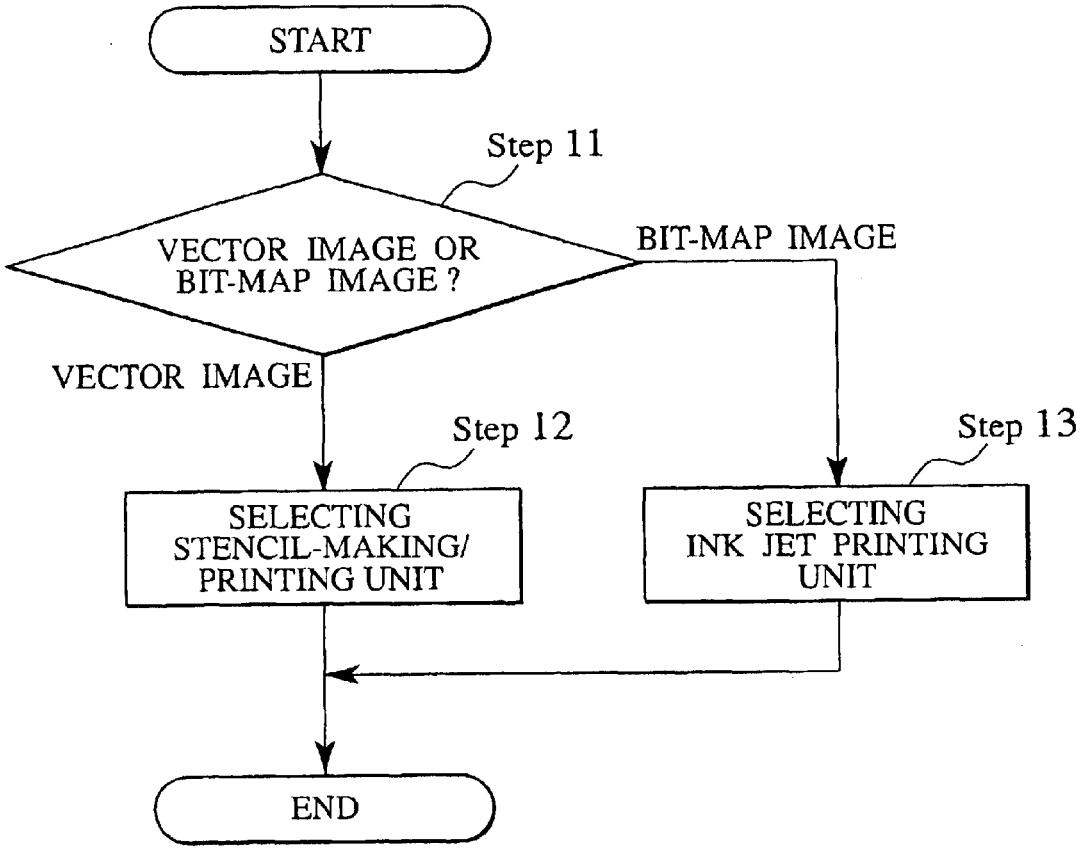
FIG. 9 is a flow chart showing processing procedure of the image-formation unit selection-unit in the hybrid stencil printing apparatus of the fourth embodiment.

The image-formation unit selection-unit 53*b* selects an image-formation unit based on the flow chart shown in FIG. 9 according to a determination result of the vector/bit-map determining unit 56.

First, as for each image region in the original digital image, whether that image region is expressed in vector or bit-map data is determined and according to this determination result (step 11), if it is a vector image, the stencil-making/printing unit 7 is selected as the print means for the image portion (step 12). The relevant image portion is sent to the first RIP 54 which transforms the original digital image into a raster image corresponding to the print color and resolution of the stencil-making/printing unit 7 in the hybrid stencil printing apparatus 1 and sends it to the stencil-making/printing unit 7.

Conversely, if the image region is a bit-map image, the ink jet printing unit 5 is allocated as the print means for the image portion (step 13). The relevant image portion is sent to the second RIP 55 which transforms the original digital image into a raster image corresponding to the print color and resolution of the ink jet printing unit 5 and sends it to the ink jet printing unit 5.

Figure 10:
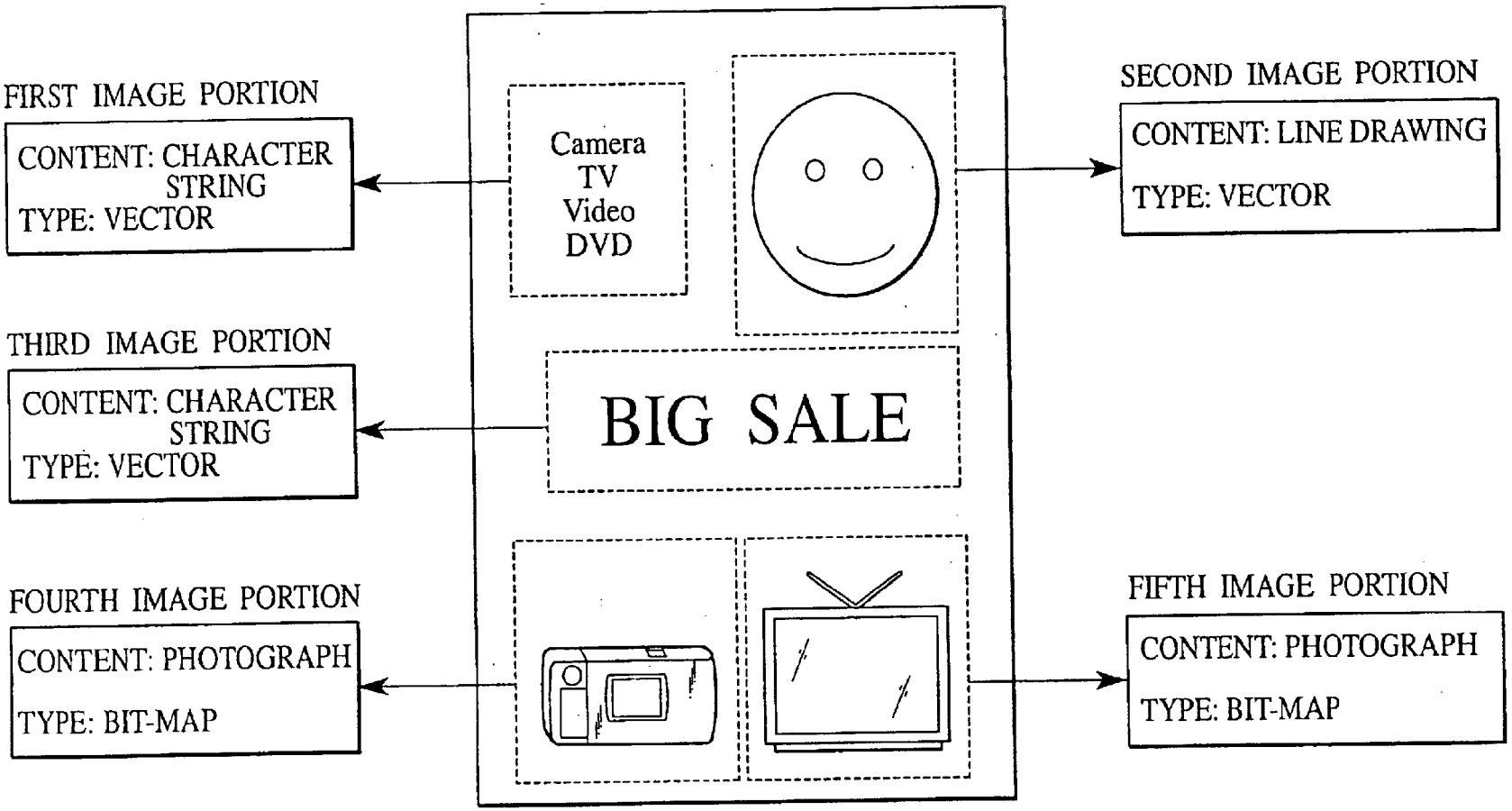
FIG. 10 is an image diagram showing an example of original digital image in the hybrid stencil printing apparatus of the fourth embodiment.

Assume that an ink drum filled with "black" ink is loaded on the stencil-making/printing unit 7 of the hybrid stencil printing apparatus 1 and a color ink cartridge is loaded on the ink jet printing unit 5 as in the first and second embodiments. If the original digital image data shown in FIG. 10 is used, the image-formation unit selected for each of the image portions (first image portion—fifth image portion) is as shown in Table 2.

TABLE 2

| Original image portion | Content | Type | Stencil-making/ printing unit | Ink jet printing unit |
|---|---|---|---|---|
| First image portion | Character string | Vector | Selected | Not selected |
| Second image portion | Line drawing | Vector | Selected | Not selected |
| Third image portion | Character string | Vector | Selected | Not selected |
| Fourth image portion | Photograph | Bit-map | Not selected | Selected |
| Fifth image portion | Photograph | Bit-map | Not selected | Selected |

As shown in Table 2, because the character data in the first image portion, line drawing data in the second image portion and character string data in the third image portion are types of vector, the stencil-making/printing unit 7 is selected. Further, because the photographic data in the fourth image portion and fifth image portion are types of "bit-map", the ink jet printing unit 5 is selected.

That is, because the image-formation unit can be alternated depending on whether each image portion in the digital original image outputted from an application software is a vector or bit-map image, it is possible to provide an excellent quality image even on rough surface paper. That is, because a vector image such as the character and line drawing loses its quality if the surface is blurred on a rough paper, a finer image can be attained if it is printed by means of the stencil-making/printing unit 7. On the other hand, because the bit-map image outputted from the application software is often photographic, the influence of blur is low and therefore, if the original color is expressed with the other-method image-formation unit capable of expressing in colors, an excellent quality image can be provided.

[Fifth Embodiment]

(Selecting an Image-Formation Unit by Manual Image Allocation According to User's Desires)

Figure 11:
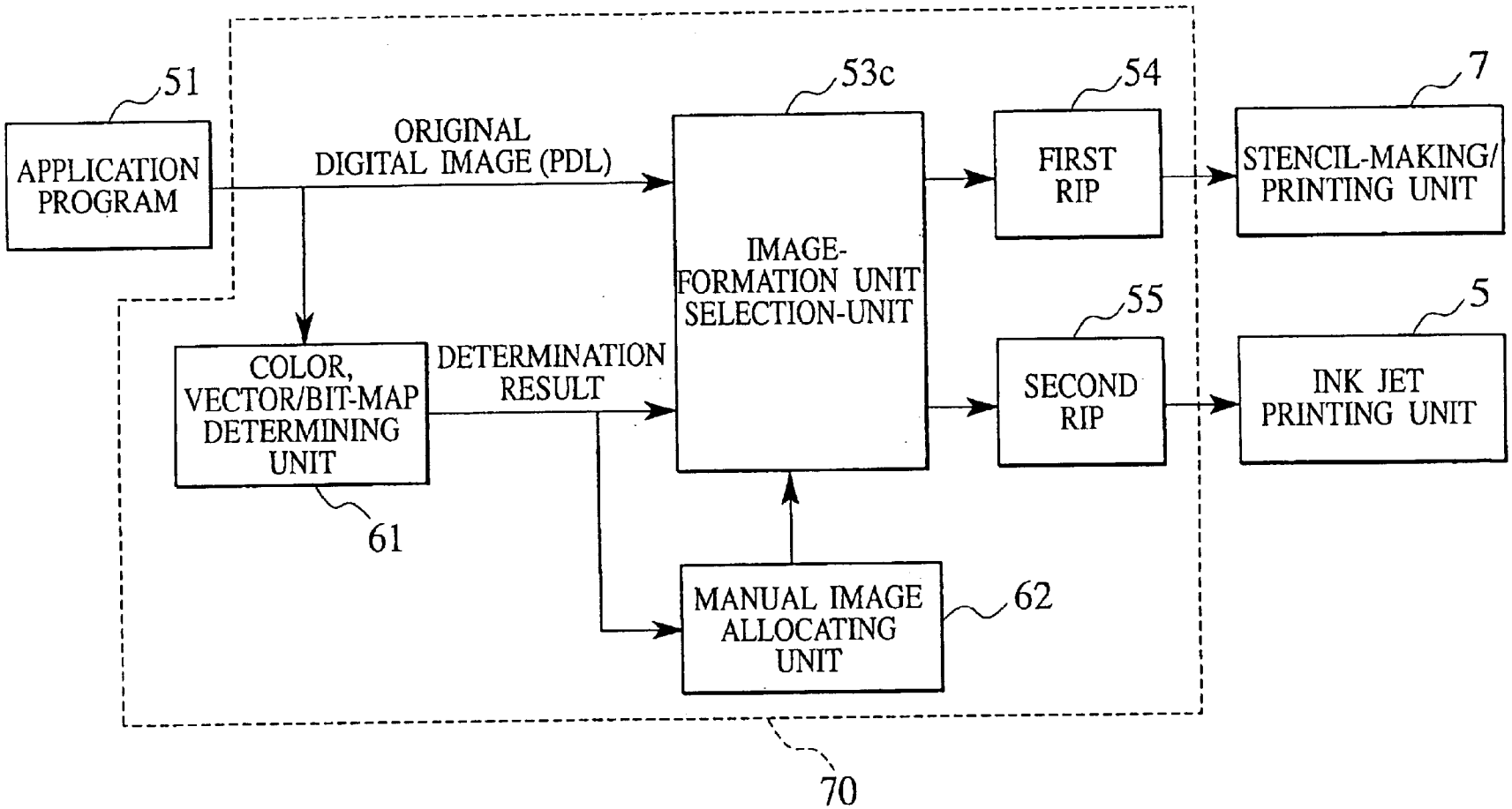
FIG. 11 is a block diagram showing function block of the hybrid stencil printing apparatus according to a fifth embodiment.

The hybrid stencil printing apparatus 1 of this embodiment is connected to a personal computer installed with, for example, a word processing application software as shown in FIG. 11. The application program 51 in the same Figure is an application software installed in a personal computer. A color, vector/bit-map determining unit 61, a manual image allocating unit 62, an image-formation unit selection-unit 53*c*, a first RIP 54 and a second RIP 55 are the functions of a printer driver 70 installed in the personal computer.

A color, vector/bit-map determining unit 61 determines which of the following four types each image region in the original digital image (PDL) outputted from the application program 51 falls within and outputs a determination result to the image-formation unit selection-unit 53*c* and a manual image allocating unit 62.

(1) Vector image in the same color as the drum color of the stencil-making/printing unit 7 where, the drum color stands for the color of the ink filling the drum.

(2) Vector image not in the same color as the drum color of the stencil-making/printing unit 7 where, the drum color stands for the color of the ink filling the drum.

(3) Bit-map image in the same color as the drum color of the stencil-making/printing unit 7 where, the drum color stands for the color of the ink filling the drum.

(4) Bit-map image not in the same color as the drum color of the stencil-making/printing unit 7 where, the drum color stands for the color of the ink filling the drum.

The manual image allocating unit 62 is provided with a user interface for inquiring whether the vector image not in the same color as the ink in the drum of the stencil-making/printing unit 7 in the above-described (2); and whether the bit-map image is in the same color as the color of the ink in the drum of the stencil-making/printing unit 7 in the above-described (3); and then the images are formed by either the stencil-making/printing unit 7 or the ink jet printing unit 5. This inquiry via the user interface may be conducted each time when user prints or may be set up by user depending on his needs as a basic setting of the hybrid stencil printing apparatus 1.

If it is intended to faithfully reproduce the colors of the original, the user can select to form the vector image not in the drum color of the stencil-making/printing unit 7 in the above (2) but by means of the ink jet printing unit 5. On the other hand, if it is intended to express the contours of a character or line drawing without blur, it is possible to select to form the vector image not in the drum color of the stencil-making/printing unit 7 in the above described (2) but by means of the stencil-making/printing unit 7.

A bit-map image in the drum color of the stencil-making/printing unit 7 in the above (3) is often a monochrome photograph. If the stencil-making/printing unit 7 forms such a monochrome photograph, there is a little blurring of the dots composing the photograph. On the other hand, because the ink jet printing unit 5 ensures a higher resolution than the stencil-making/printing unit 7, a print product having a high resolution can be obtained although dots are more blurred when the monochrome photograph is formed by the ink jet printing unit 5. The user can select which image-formation unit should be selected on considerations of these points.

The manual image allocating unit 62 outputs the result of inquiry to user to the image-formation unit selection-unit 53*c*.

Figure 12:
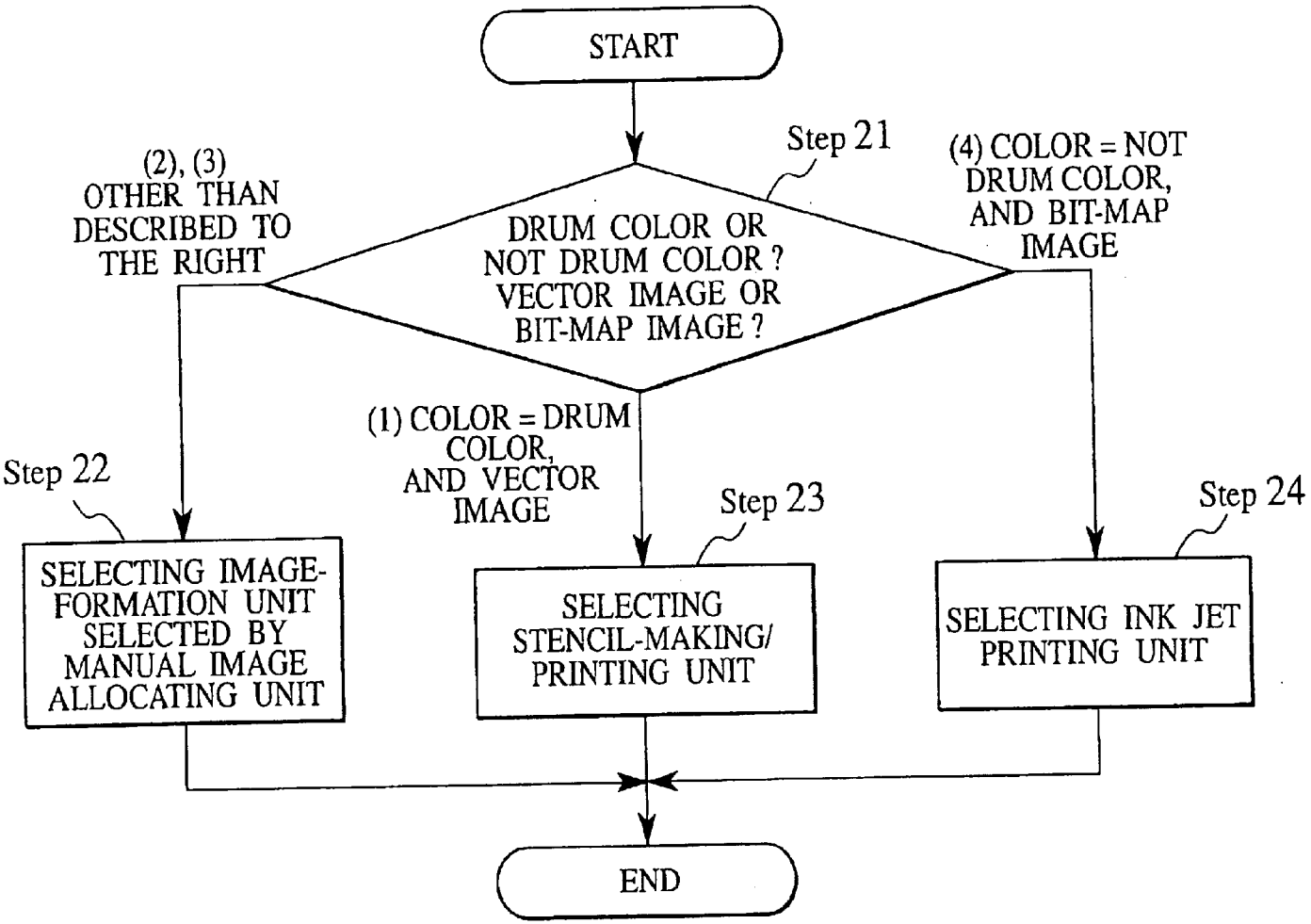
FIG. 12 is a flow chart showing the processing procedure of the image-formation unit selection-unit in the hybrid stencil printing apparatus of the fifth embodiment.

The image-formation unit selection-unit 53*c* selects an image-formation unit according to the flow chart shown in FIG. 12 based on the determination result of the color, vector/bit-map determining unit 61 and the inquiry result of the manual image allocating unit 62.

As for each image region in the original digital image, the color, the vector/bit-map determining unit 61 determines whether the drum color of the stencil-making/printing unit 7 should be applied and distinguishes between whether a vector or bit-map image has been employed (step 21).

If the determination result is a vector image in the drum color of the stencil-making/printing unit 7 in the above (1), the stencil-making/printing unit 7 is selected as the printing means for the image portion (step 23). The relevant image portion is sent to the first RIP 54, and the first RIP 54 transforms the original digital image into a raster image corresponding to the print color and resolution of the stencil-making/printing unit 7 in the hybrid stencil printing apparatus 1 and sends it to the stencil-making/printing unit 7.

If the determination result in step 21 is a bit-map image that is not in the drum color of the stencil-making/printing unit 7, as with the above-described (4), the ink jet printing unit 5 is allocated as the print means for the image portion (step 24). Then, the relevant image portion is sent to the second RIP 55 and then, the second RIP 55 transforms the original digital image into a raster image depending on the print color and resolution of the ink jet printing unit 5 in the hybrid stencil printing apparatus 1 and sends it to the inkjet printing unit 5.

If the determination result in step 21 is a vector image that is not in the drum color of the stencil-making/printing unit 7 as in (2) or a bit-map image in the drum color of the stencil-making/printing unit 7 as in (3), the stencil-making/printing unit 7 or the ink jet printing unit 5 can be selected according to the result of an inquiry to the user by the manual image allocating unit 62 (step 22).

Figure 13:
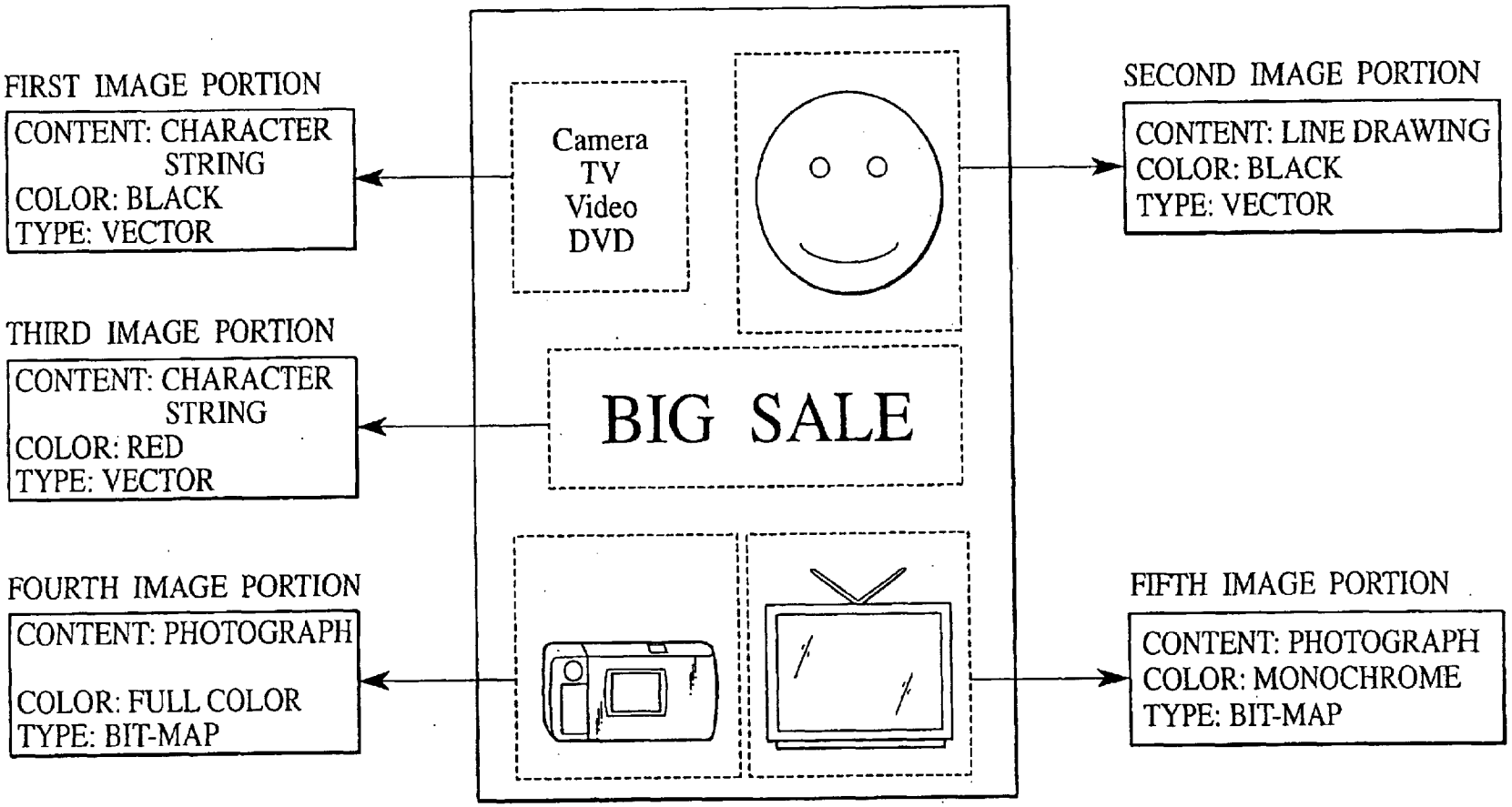
FIG. 13 is an image diagram showing an example of the original digital image in the hybrid stencil printing apparatus of the fifth embodiment.

For example, assume that an ink drum filled with "black" ink is loaded on the stencil-making/printing unit 7 in the hybrid stencil printing apparatus 1 and a color ink cartridge is mounted on the inkjet printing unit 5. Then, if the original digital image data shown in FIG. 13 is used, as the image portions (first to fifth image portions) of the original digital image, the image-formation units shown in Table 3 are selected.

TABLE 3

| Original image portion | Content | Color | Type | Stencil-making/printing unit | Ink jet printing unit |
|---|---|---|---|---|---|
| First image portion | Character string | Black | Vector | Selected | Not selected |
| Second image portion | Line drawing | Black | Vector | Selected | not selected |
| Third image portion | Character string | Red | Vector | Manually selected | Manually selected |
| Fourth image portion | Photograph | Full color | Bit-map | Not selected | Selected |
| Fifth image portion | Photograph | Mono-chrome | Bit-map | Manually selected | Manually selected |

According to this embodiment, the user can select whether faithfulness in color reproduction or scarcity of blur on a rough surface paper is preferable in the vector images of the original digital images outputted from the application software. Further, the user can select whether scarcity of blur on a rough surface paper or resolution is preferable in the bit-map images of the original digital images. Then, because the image-formation unit is automatically allocated based on the result selected by the user, it is possible to provide an excellent image as desired by the user.

Although the embodiments of the present invention have been described in detail with regard to the first to fifth embodiments, the present invention is not restricted to those embodiments and may be improved or changed within a scope not departing from a gist of the present invention.

For example, although an example in which an ink jet printing unit which prints by ejecting ink is provided as the other-method printing unit in the hybrid stencil printing apparatus 1, the form of the other-method printing unit is not restricted to this example. Any printing unit may be employed so long as it has such a printing style in which although a spot color print or full color print can be provided at registration accuracy without any problem in practical application at a low cost, an excellent quality image cannot be provided on a rough surface paper.

Although according to this embodiment, the other-method printing unit is disposed in the upstream of the hybrid stencil printing apparatus 1 while the stencil-making/printing unit is disposed in the downstream, it is permissible to dispose the other-method printing unit in the downstream and the stencil-making/printing unit in the upstream.

Although according to this embodiment, the stencil-making/printing unit is so constructed that the printed paper 2 is fed to the print drum 21 with pressure on which the stencil sheet is wound around so as to transfer a print image on the stencil sheet directly to the printed paper 2, this includes a case in which a transfer drum is pressed to the print drum to transfer a print image on the stencil sheet to the transfer drum temporarily and the print image is formed on the print paper via the transfer drum.

Although third to fifth embodiments show examples in which respective functions are achieved by the printer driver installed in a personal computer, the respective functions provided on the printer driver 70 may be installed in the hybrid stencil printing apparatus 1.

According to this embodiment, in the hybrid stencil printing apparatus including the stencil-making/printing unit and other-method image-formation unit which differs from this stencil-making/printing unit, it is possible to use the advantages of each printing unit while compensating for the weak point of each. Consequently, excellent quality spot color print or full color print can be achieved even on, for example, rough surface paper.

That is, according to a first feature of this embodiment, a color image portion of the original digital image, which the stencil-making/printing unit 7 is incapable of treating, can be allocated to other method image-formation unit capable of expressing color. Consequently, a print result faithful to the original can be obtained. Further, because the formation of an image corresponding to the ink color of the stencil-making/printing unit 7 such as character and line drawing is allocated to the stencil-making/printing unit, an excellent quality print image can be provided even on a rough surface paper.

According to a second feature of this embodiment, the image-formation unit can be alternated depending on whether a respective image portion of the original digital image is a vector image or bit-map image. Consequently, an excellent quality image can be provided even on rough surface paper. That is, because the vector image such as character and line drawing loses its quality if it is blurred on a rough surface paper, the stencil-making/printing unit can provide a finer print image. On the other hand, because the bit-map image outputted from the application software is often photographic, the influence of the blur thereon is smaller and therefore, if it is expressed by the other method image-formation unit capable of expressing in colors faithful to the original, an excellent quality image can be provided.

Further according to a third feature of this embodiment, the user can select whether faithfulness in color reproduction or scarcity of blur on rough surface paper is preferable in a vector image portion of the original digital image outputted from an application software, or whether scarcity of blur on rough surface paper or resolution is preferable in a bit-map image portion of the original digital images. Then, an image-formation unit is allocated based on the result of the user's selection. Thus, it is possible to provide an excellent quality image as desired by the user.

What is claimed is:

1. A hybrid stencil printing apparatus comprising:

a stencil-making/printing unit configured to perforate a stencil sheet corresponding to a desired image, to wind the stencil sheet around an outer peripheral surface of a print drum, and to transfer a printing medium to the print drum with pressure, thereby printing the printing medium;

an other-method image-formation unit configured to print the printing medium transferred on a same transfer passage as the stencil-making/printing unit according to a different printing method from the stencil-making/printing unit; and an image-formation unit selection-unit configured to input an original digital image, to determine attributes of image portions of the inputted original digital image, and to allocate each image portion selectively to the stencil-making/printing unit and the other-method image-formation unit based on the determination result; wherein the image-formation unit selection-unit determines whether each image portion of the original digital image is a vector or bit-map image, allocates the vector image portions to the stencil-making/printing unit, and allocates the bit-map image portions to the other-method image-formation unit.

2. A hybrid stencil printing apparatus comprising:

a stencil-making/printing unit configured to perforate a stencil sheet corresponding to a desired image, to wind the stencil sheet around an outer peripheral surface of a print drum, and to transfer a printing medium to the print drum with pressure, thereby printing the printing medium;

an other-method image-formation unit configured to print the printing medium transferred on a same transfer passage as the stencil-making/printing unit according to a different printing method from the stencil-making/printing unit; and an image-formation unit selection-unit configured to input an original digital image, to determine attributes of image portions of the inputted original digital image, and to allocate each image portion selectively to the stencil-making/printing unit and the other-method image-formation unit based on the determination result; and further comprising:

a manual image allocating unit configured to allocate the image portions of the original digital image selectively to the stencil-making/printing unit and the other-method image- formation unit manually based on the desires of a user; wherein the image-formation unit selection-unit determines color attributes of each image portion of the original digital image, determines whether the image portion is a vector or bit-map image, allocates the vector image portions in a color which ink in the stencil-making/printing unit is capable of treating to the stencil-making/printing unit; allocates the bit-map image portions in a color which the ink in the stencil-making/printing unit is incapable of treating to the other-method image- formation unit; allocates the bit-map image portions in the color which the ink in the stencil-making/printing unit is capable of treating to the image-formation unit allocated by the manual image allocating unit; and allocates the vector image portions in the color which the ink in the stencil- making/printing unit is incapable of treating to the image-formation unit allocated by the manual image allocating unit.

3. A method for controlling a hybrid stencil printing apparatus, the hybrid stencil printing apparatus including a stencil-making/printing unit and an other- method image-formation unit, the method comprising:

inputting an original digital image, determining attributes of image portions of the inputted original digital image, and allocating each image portion selectively to the stencil- making/printing unit and the other-method image-formation unit based on the determination result;

perforating a stencil sheet corresponding to the image allocated to the stencil-making/printing unit, winding the stencil sheet around an outer peripheral surface of a print drum, and transferring a printing medium to the print drum with pressure and thereby printing the printing medium, in the stencil-making/printing unit; and printing the image allocated to the other-method image-formation unit on the printing medium according to a different printing method from the stencil-making/printing unit in the other-method image-formation unit; wherein in said allocation of the image portion, whether each image portion of the original digital image is vector or bit-map image is determined, the vector image portions are allocated to the stencil-making/printing unit, and the bit-map image portions are allocated to the other-method image-formation unit.

4. A method for controlling a hybrid stencil printing apparatus, the hybrid stencil printing apparatus including a stencil-making/printing unit and an other- method image-formation unit, the method comprising:

inputting an original digital image, determining attributes of image portions of the inputted original digital image, and allocating each image portion selectively to the stencil- making/printing unit and the other-method image-formation unit based on the determination result;

perforating a stencil sheet corresponding to the image allocated to the stencil-making/printing unit, winding the stencil sheet around an outer peripheral surface of a print drum, and transferring a printing medium to the print drum with pressure and thereby printing the printing medium, in the stencil-making/printing unit; and printing the image allocated to the other-method image-formation unit on the printing medium according to a different printing method from the stencil-making/printing unit in the other-method image-formation unit; and further comprising:

manually allocating the image portions in the original digital image selectively to the stencil-making/printing unit and the other-method image-formation unit based on the desires of a user; wherein in said allocation of the image portion, color attributes of each image portion of the original digital image are determined, whether the image is of a vector or of bit-map image is determined, the vector image portions in a color which ink in the stencil-making/printing unit is capable of treating are allocated to the stencil-making/printing unit, the bit-map image portions of a color which the ink in the stencil-making/printing unit is incapable of treating are allocated to the other-method image-formation unit, the bit-map image portions in the color which the ink of the stencil-making/printing unit is capable of treating are allocated to the image-formation unit allocated by the manual image allocation, and the vector image portions in the color which the ink of the stencil-making/printing unit is incapable of treating are allocated to the image-formation unit allocated by the manual image allocation.

5. A computer-readable recording medium, recording a program for controlling a hybrid stencil printing apparatus, the hybrid stencil printing apparatus including a stencil-making/printing unit and an other-method image-formation unit, the program comprising:

inputting an original digital image, determining attributes of image portions of the inputted original digital image, and allocating each image portion selectively to the stencil- making/printing unit and the other-method image-formation unit based on the determination result;

perforating a stencil sheet corresponding to the image allocated to the stencil-making/printing unit, winding the stencil sheet around an outer peripheral surface of a print drum, and transferring a printing medium to the print drum with pressure and thereby printing the printing medium, in the stencil-making/printing unit; and printing the image allocated to the other-method image-formation unit on the printing medium according to a different printing method from the stencil-making/printing unit in the other-method image-formation unit;

the program wherein in said allocation of the image portion whether each image portion of the original digital image is vector or bit-map image is determined, the vector image portions are allocated to the stencil-making/printing unit, and the bit-map image portions are allocated to the other-method image-formation unit.

6. A computer-readable recording medium, recording a program for controlling a hybrid stencil printing apparatus, the hybrid stencil printing apparatus including a stencil-making/printing unit and an other-method image-formation unit, the program comprising:

inputting an original digital image, determining attributes of image portions of the inputted original digital image, and allocating each image portion selectively to the stencil- making/printing unit and the other-method image-formation unit based on the determination result;

perforating a stencil sheet corresponding to the image allocated to the stencil-making/printing unit, winding the stencil sheet around an outer peripheral surface of a print drum, and transferring a printing medium to the print drum with pressure and thereby printing the printing medium, in the stencil-making/printing unit; and printing the image allocated to the other-method image-formation unit on the printing medium according to a different printing method from the stencil-making/printing unit in the other-method image-formation unit; the program further comprising:

manually allocating the image portions in the original digital image selectively to the stencil-making/printing unit and the other-method image-formation unit based on the desires of a user; wherein in said allocation of the image portion, color attributes of each image portion of the original digital image are determined, whether the image portion is of a vector or of bit-map image is determined, the vector image portions in a color which ink in the stencil- making/printing unit is capable of treating are allocated to the stencil-making/printing unit, the bit-map image portions in a color which the ink in the stencil- making/printing unit is incapable of treating are allocated to the other-method image-formation unit, the bit-map image portions in the color which the ink of the stencil-making/printing unit is capable of treating are allocated to the image-formation unit allocated by the manual image allocation, and the vector image portions in the color which the ink of the stencil-making/printing unit is incapable of treating are allocated to the image-formation unit allocated by the manual image allocation.

* * * * *